US012305910B2

(12) United States Patent
Okada

(10) Patent No.: US 12,305,910 B2
(45) Date of Patent: May 20, 2025

(54) REFRIGERATION APPARATUS

(71) Applicant: PHC Holdings Corporation, Tokyo (JP)

(72) Inventor: Tadashi Okada, Saitama (JP)

(73) Assignee: PHC Holdings Corporation, Tokyo (JP)

( * ) Notice: Subject to any disclaimer, the term of this patent is extended or adjusted under 35 U.S.C. 154(b) by 402 days.

(21) Appl. No.: 17/841,227

(22) Filed: Jun. 15, 2022

(65) Prior Publication Data

US 2022/0307757 A1 Sep. 29, 2022

Related U.S. Application Data

(63) Continuation of application No. PCT/JP2020/044765, filed on Dec. 2, 2020.

(30) Foreign Application Priority Data

Dec. 18, 2019 (JP) ..... 2019-228074

(51) Int. Cl.
*F25D 23/02* (2006.01)
*F25D 23/00* (2006.01)
*F25D 23/06* (2006.01)

(52) U.S. Cl.
CPC ..... *F25D 23/028* (2013.01); *F25D 23/006* (2013.01); *F25D 23/025* (2013.01); *F25D 23/061* (2013.01); *F25D 23/069* (2013.01)

(58) Field of Classification Search
CPC .... F25D 23/028; F25D 23/006; F25D 23/025; F25D 23/061; F25D 23/069; F25D 21/04; F25B 47/022

(Continued)

(56) References Cited

U.S. PATENT DOCUMENTS 1,589,064 A * 6/1926 Gearhart ..... F25D 23/025 62/517
2,135,091 A * 11/1938 Newill ..... F25D 21/04 62/DIG. 13

(Continued)

FOREIGN PATENT DOCUMENTS

CN 1485589 A 3/2004
CN 116783437 A * 9/2023 ..... B65D 81/3818

(Continued)

OTHER PUBLICATIONS

Extended European Search Report dated Nov. 25, 2022 issued in the corresponding European Patent Application No. 20900743.4.

(Continued)

*Primary Examiner* — Len Tran
*Assistant Examiner* — Kirstin U Oswald
(74) *Attorney, Agent, or Firm* — Rimon P.C.

(57) ABSTRACT

A refrigeration apparatus performs refrigeration by freezing circuitry using refrigerant. The refrigeration apparatus includes: an inner door that is provided with a thermal insulation material inside; a case section that includes a peripheral edge section facing a perimeter section of the inner door while the inner door is closed, and that is refrigerated inside by the refrigerant; a packing that is pressed between the perimeter section of the inner door and the peripheral edge section while the inner door is closed; a pipe that is placed along the peripheral edge section, and that circulates the refrigerant warmed by a compression effect of a compressor; and an outer door that covers the inner door while the inner door is closed.

6 Claims, 8 Drawing Sheets

(58) Field of Classification Search
USPC ..... 62/259.1
See application file for complete search history.

(56) References Cited

U.S. PATENT DOCUMENTS

| | | | | | |
|---|---|---|---|---|---|
| 2,171,712 | A * | 9/1939 | Thomas | F25D 23/025 | 62/526 |
| 2,509,784 | A * | 5/1950 | Roth | F25D 21/04 | 62/278 |
| 2,945,733 | A * | 7/1960 | Malia | F25D 23/04 | 312/283 |
| 3,601,463 | A * | 8/1971 | Watt | F25D 17/065 | 312/236 |
| 4,481,785 | A * | 11/1984 | Tershak | F25D 21/006 | 62/155 |
| 5,737,939 | A * | 4/1998 | Valence | F25D 11/04 | 312/401 |
| 7,337,628 | B2 * | 3/2008 | Okuda | F25D 23/025 | 62/447 |
| 2005/0138955 | A1 | 6/2005 | Okuda et al. | | |
| 2011/0030402 | A1 * | 2/2011 | Shinya | F25B 49/022 | 62/203 |
| 2018/0073799 | A1 * | 3/2018 | Okazaki | F25D 23/069 | |
| 2020/0088455 | A1 | 3/2020 | Toyooka et al. | | |

FOREIGN PATENT DOCUMENTS

| | | | |
|---|---|---|---|
| JP | H05-060456 | A | 3/1993 |
| JP | H11-311478 | A | 11/1999 |
| JP | 2005-147476 | A | 6/2005 |
| JP | 2005-147650 | A | 6/2005 |
| JP | 2010-038528 | A | 2/2010 |
| JP | S49-001494 | | 1/2016 |
| JP | 2019-158284 | A | 9/2019 |
| WO | 2018/216463 | A1 | 11/2018 |
| WO | 2019/225690 | A1 | 11/2019 |

OTHER PUBLICATIONS

International Search Report dated Jan. 12, 2021 issued in International Patent Application No. PCT/JP2020/044765, with English translation.

* cited by examiner

22 { 27, 292 }  23 { 28, 291 }

REFRIGERATION APPARATUS

CROSS-REFERENCE OF RELATED APPLICATIONS

This application is a Continuation of International Patent Application No. PCT/JP2020/044765, filed on Dec. 2, 2020, which in turn claims the benefit of Japanese Patent Application No. 2019-228074, filed on Dec. 18, 2019, the entire disclosures of which applications are incorporated by reference herein.

TECHNICAL FIELD

The present disclosure relates to a refrigeration apparatus.

BACKGROUND ART

A conventionally-used refrigeration apparatus has a case section the inner space of which is refrigerated by freezing circuitry. For such a refrigeration apparatus, the case section is provided with an opening that leads to the inner space as well as a door that is openable and closable.

A section between an opening peripheral edge and the door of such a refrigeration apparatus tends to have poorer thermal insulation than other sections. Accordingly, the section between the opening peripheral edge and the door is more prone to condensation and frosting than other sections.

Patent Literature (hereinafter, referred to as PTL) 1 discloses an invention for preventing such condensation and frosting. That is, PTL 1 discloses a storage provided with a sliding rubber around a lower edge of a door, and an insulation space formed by the sliding rubber is heated by a heater wire. It is thus possible to prevent condensation and frosting around the lower edge of the door.

CITATION LIST

Patent Literature

PTL 1

Japanese Patent Application Laid-Open No. 2005-147476

SUMMARY OF INVENTION

Technical Problem

The storage disclosed in PTL 1 possibly prevents condensation and frosting around the lower edge of the door, i.e., around the lower edge of the opening of the storage. It is not expected, however, to prevent condensation and frosting in sections other than around the lower edge of the opening of the storage.

In recent years, a refrigeration apparatus provided with two doors, which are an inner door and an outer door, has been widely used. The refrigeration apparatus with a heat insulating inner door is likely to have condensation and frosting at a section between the opening peripheral edge and the inner door. Thus, a technique is demanded to prevent condensation and frosting around the opening peripheral edge, even in a case with a thermal insulating inner door.

It is an objective of the present disclosure to provide a refrigeration apparatus capable of preventing condensation and frosting around an opening peripheral edge, in a case with a thermal insulating inner door.

Solution to Problem

A refrigeration apparatus according to the present disclosure includes: a case section that includes an opening; an inner door that is provided with a heat insulation material inside, and that opens and closes the opening; an outer door that is provided so as to cover the inner door while the inner door is closed, and that opens and closes the opening; a peripheral edge member that is provided so as to surround the opening, and that includes a section facing a peripheral edge section of the inner door in a closed state and a section facing a peripheral edge section of the outer door in a closed state, the peripheral edge member being made of a resin; a packing that seals between the peripheral edge section of the inner door in the closed state and the peripheral edge member; and a pipe that is placed along a section, of the peripheral edge member, facing the inner door, and that circulates refrigerant warmed by an effect of a compressor composing a refrigerating cycle.

Advantageous Effects of Invention

According to the present disclosure, it is possible to prevent condensation and frosting around an opening peripheral edge, in a case with a thermal insulating inner door.

DESCRIPTION OF EMBODIMENTS

An embodiment of the present disclosure is described in detail below with reference to the accompanying drawings. Note that the embodiment described below is merely an example, and the present disclosure is not limited to the present embodiment.

Figure 1:
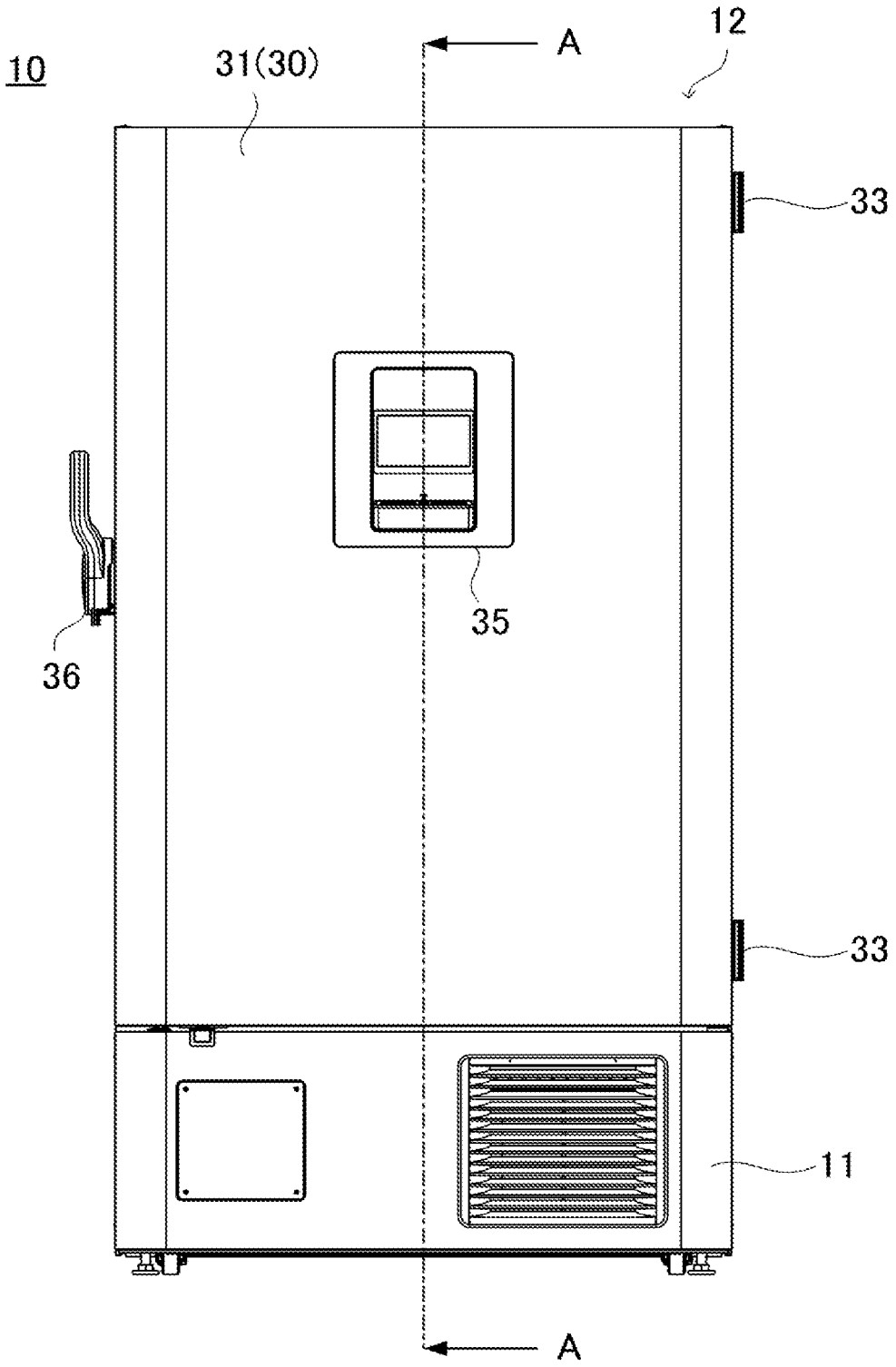
FIG. 1 is a front view of a refrigeration apparatus.
Figure 2:
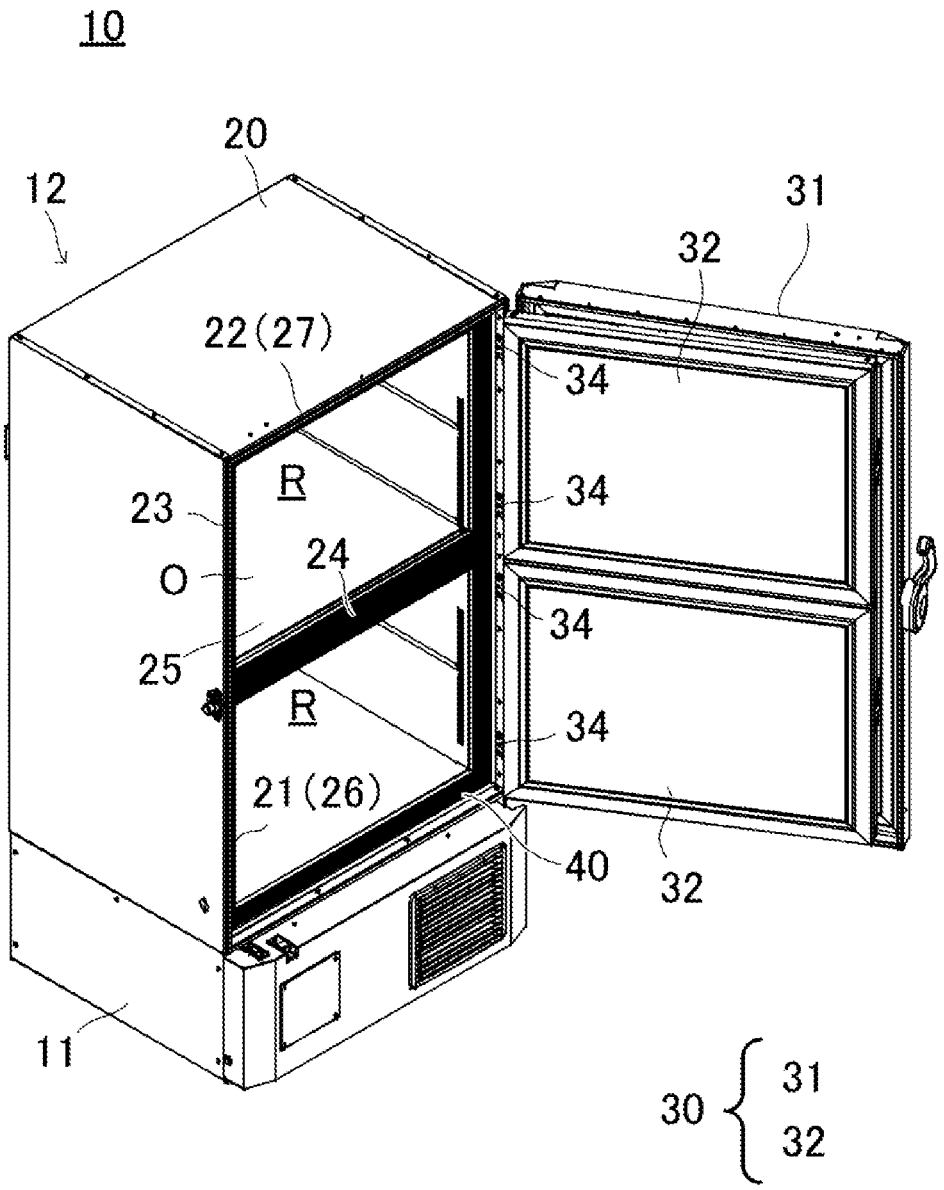
FIG. 2 is a perspective view of the refrigeration apparatus with an outer door and an inner door both opened.

FIG. 1 is a front view of refrigeration apparatus 10 according to an embodiment of the present disclosure. FIG. 2 is a perspective view of refrigeration apparatus 10 with outer door 31 and inner door 32 both opened. Refrigeration apparatus 10 includes device storage 11, and body 12 that is provided above device storage 11. Note that, in the following description, the direction of refrigeration apparatus 10 illustrated in FIG. 1 is referred to as a front side. In addition, a vertical (upper-lower) direction in the following description corresponds to the vertical (upper-lower) direction in FIG. 1. Further, a right-left direction in the following description corresponds to the right-left direction when refrigeration apparatus 10 is viewed from the back side.

Various devices composing freezing circuitry, and a controller (not illustrated) are placed inside of device storage 11.

Body 12 includes case section 20, and door 30 that is attached on the front side of case section 20 so as to open and close. Door 30 includes outer door 31 on the outside of refrigeration apparatus 10, and inner door 32 on the inner side of outer door 31. As illustrated in FIG. 2, refrigeration apparatus 10 includes two inner doors 32 arranged vertically.

As illustrated in FIG. 1, outer door 31 is attached to case section 20 via hinges 33. As illustrated in FIG. 2, inner doors 32 are attached to case section 20 via hinges 34.

Outer door 31 is provided with operation section 35 where instructions for refrigeration apparatus 10 is inputted, and knob 36. Outer door 31 is opened by knob 36 operated as illustrated in FIG. 2. In addition, packing 40 is attached at an opening peripheral edge of case section 20.

As illustrated in FIG. 2, case section 20 includes refrigeration chamber R inside as well as opening O that leads to refrigeration chamber R on the front side. Case section 20 further includes inner case section 21, outer case section 22, first peripheral edge section 23 (corresponding to a peripheral edge section in the present disclosure), partition 24 (corresponding to a partition member in the present disclosure), and partition plate 25.

First peripheral edge section 23 is a section that connects inner case section 21 and outer case section 22 and surrounds opening O. Partition 24 is a member that is provided approximately in the middle of the height direction of opening O so as to divide opening O into two sections vertically. Partition plate 25 is a plate member that partitions refrigeration chamber R. Note that, although only one partition plate 25 is provided in the example illustrated in FIG. 2, a plurality of partition plates 25 may be provided inside refrigeration chamber R and refrigeration chamber R may be divided into more sections.

Figure 3:
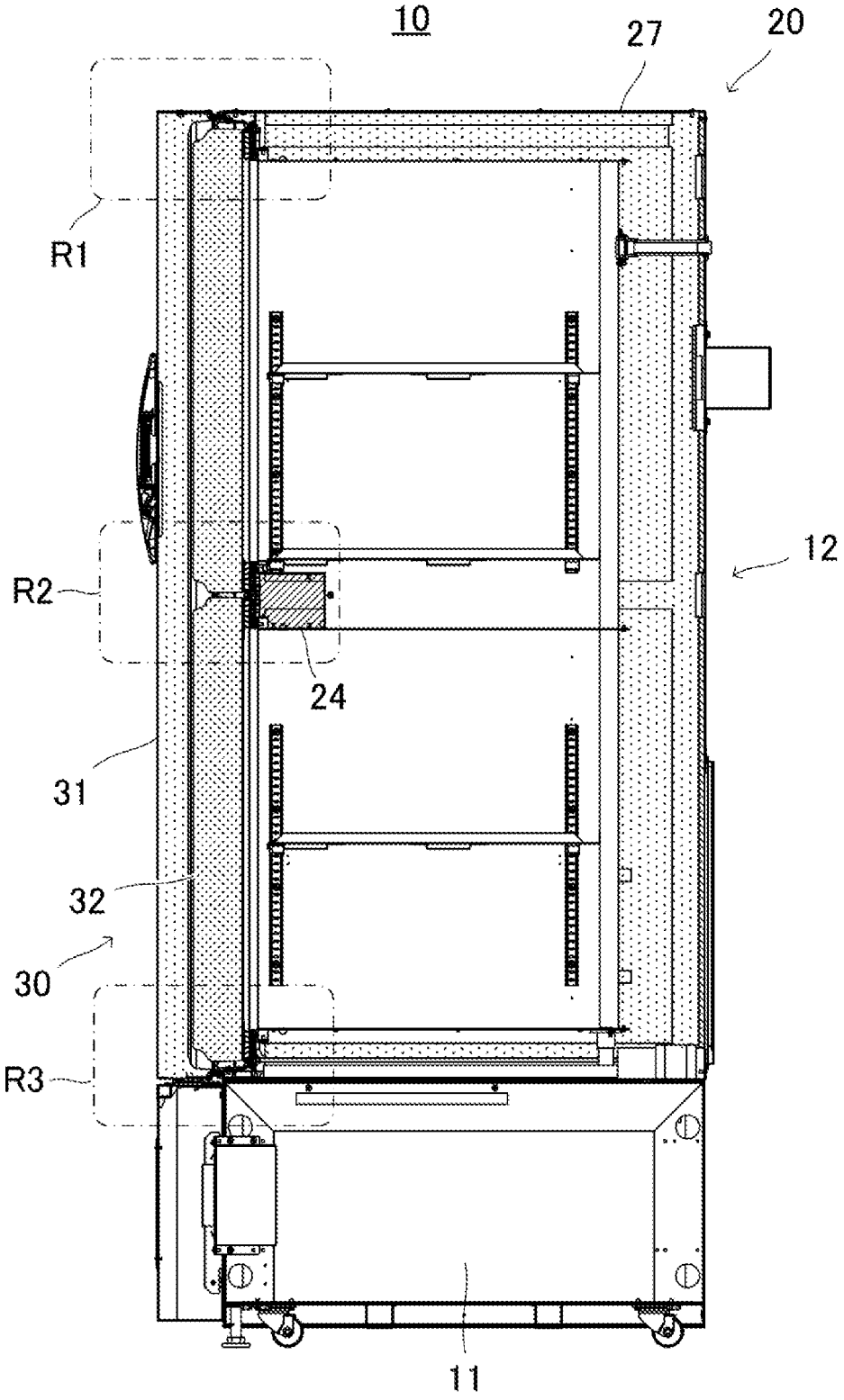
FIG. 3 is a cross-sectional view taken along the line A-A in FIG. 1.
Figure 4:
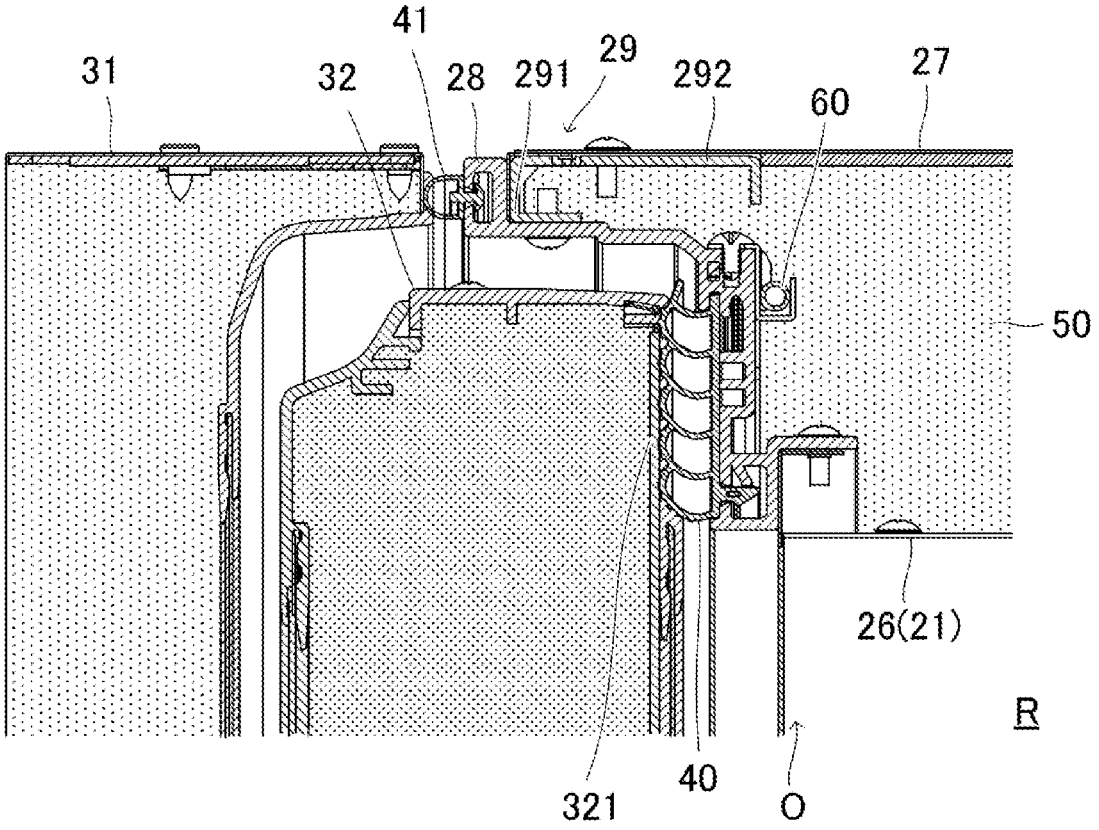
FIG. 4 is an enlarged cross-sectional view of range R1 in FIG. 3.

FIG. 3 is a cross-sectional view taken along the line A-A in FIG. 1. FIG. 4 is an enlarged cross-sectional view of range R1 in FIG. 3. Range R1 is a range around the upper edge of the perimeter of opening O of case section 20, with outer door 31 and inner doors 32 closed.

Case section 20 is mainly composed of inner case 26, outer case 27, peripheral edge member 28, and thermal insulation material 50. Inner case 26 and outer case 27 are formed of metal plates and/or synthetic resin plates. Peripheral edge member 28 is formed of a synthetic resin plate. Thermal insulation material 50 is formed of a synthetic resin.

Inner case 26 and peripheral edge member 28 are joined each other with a bracket, bolt, etc. (not illustrated). Outer case 27 and peripheral edge member 28 are also joined each other with a bracket, bolt, etc. (not illustrated).

Reinforcing member 29 (corresponding to a plate member in the present disclosure) is provided at a corner section formed by peripheral edge member 28 and outer case 27 to enhance mechanical strength of case section 20. Reinforcing member 29 has a section with a substantially L-shaped cross section, and includes first flange 291 that makes contact with peripheral edge member 28, and second flange 292 that makes contact with the inside of outer case 27. Reinforcing member 29 functions as a member reinforcing a bent section of outer case 27 and fixing a screw (not illustrated) that joins outer case 27 and peripheral edge member 28. Note that reinforcing member 29 is not necessary when outer case 27 has a desired strength or when outer case 27 has a form to be fixed to peripheral edge member 28 with a screw.

In refrigeration apparatus 10, inner case section 21 is composed of inner case 26. In refrigeration apparatus 10, outer case section 22 is composed of outer case 27 and second flange 292. In refrigeration apparatus 10, first peripheral edge section 23 is composed of peripheral edge member 28 and first flange 291.

Outer door 31 is formed of a metal plate, for example. Meanwhile, inner doors 32 are formed of thermal insulation members and metal plates surrounding the thermal insulation members, for example. That is, refrigeration apparatus 10 of the present embodiment includes thermal insulating inner doors 32.

Inner doors 32 include, at their perimeter parts, second peripheral edge section 321 that faces first peripheral edge section 23 when inner doors 32 are closed. It is preferable for peripheral edge member 28 to have a plane parallel to second peripheral edge section 321 in order to improve the sealing performance between first peripheral edge section 23 and second peripheral edge section 321 when inner doors 32 are closed. Packing 40 is provided for peripheral edge member 28 to further improve the sealing performance between first peripheral edge section 23 and second peripheral edge section 321. Note that packing 40 may be provided for second peripheral edge section 321. In addition, packing 41 is provided between outer door 31 and first peripheral edge section 23 so as to be pressed between outer door 31 and first peripheral edge section 23 when outer door 31 is closed.

Pipe 60 (corresponding to a pipe in the present disclosure) is placed outside of inner case section 21 and inside of outer case section 22 so as to make contact with the back surface of peripheral edge member 28. Pipe 60 will be described later in detail.

Figure 5:
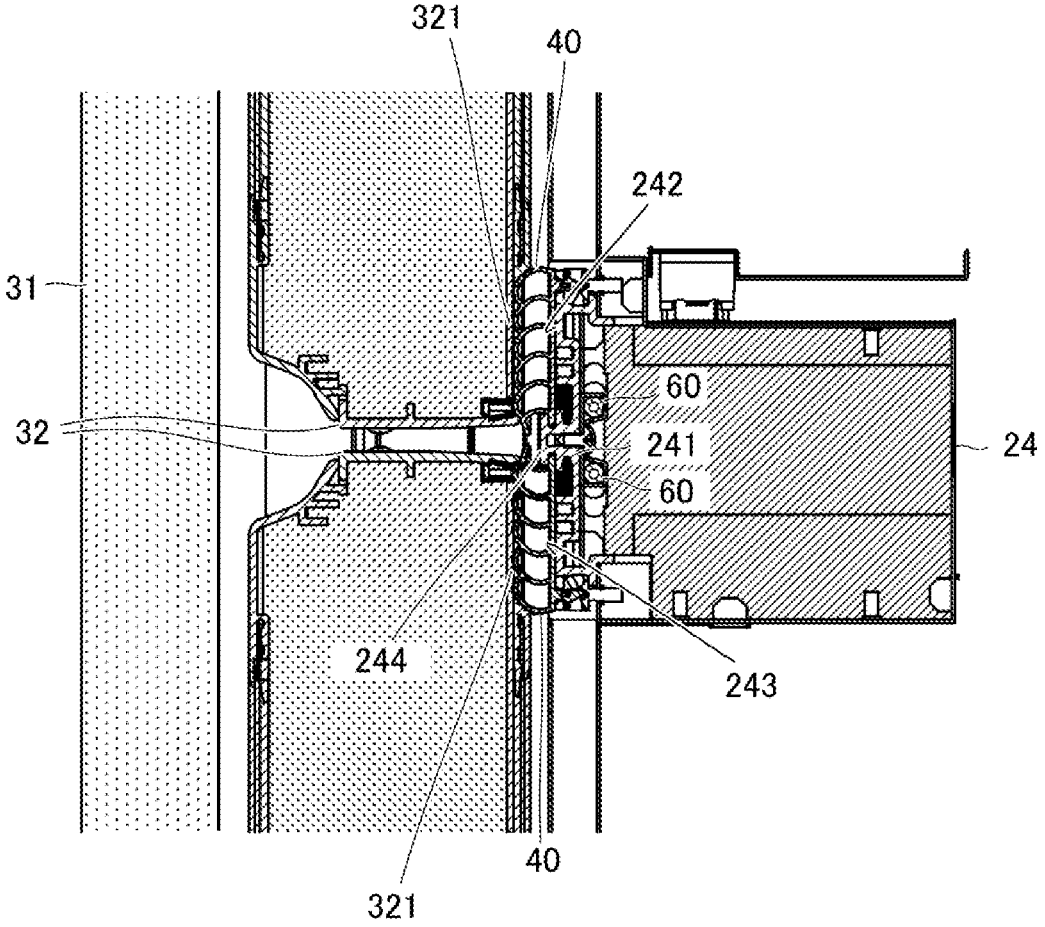
FIG. 5 is an enlarged cross-sectional view of range R2 in FIG. 3.

FIG. 5 is an enlarged cross-sectional view of range R2 in FIG. 3. Range R2 is a range around partition 24 when outer door 31 and inner doors 32 are closed.

Partition 24 includes a surface formed approximately parallel to the side of opening O in the vertical direction. Facing member 241 (corresponding to a facing section in the present disclosure) is fixed to the surface. Partition 24 and facing member 241 are formed of synthetic resin plates.

Facing member 241 is formed so that its cross section along the vertical direction has almost a vertically symmetrical shape. The upper side of facing member 241 is provided with facing surface 242 that faces second peripheral edge section 321 of upper inner door 32, and the lower side of facing member 241 is provided with facing surface 243 that faces second peripheral edge section 321 of lower inner door 32. Protrusion 244 is provided between facing surface 242 and facing surface 243 of facing member 241. Packings 40 are vertically arranged so as to make contact with protrusion 244 and respective facing surfaces 242 and 243 in order to improve the sealing performance between second peripheral edge section 321 and facing surfaces 242 and 243.

With such a configuration, when upper inner door 32 is closed, the upper half of opening O, which is vertically divided by partition 24, is closed. Likewise, when lower inner door 32 is closed, the lower half of opening O, which is vertically divided by partition 24, is closed.

Pipe 60 is placed between partition 24 and facing surface 242 of facing member 241, and between partition 24 and facing surface 243 of facing member 241. In other words, pipe 60 is placed so as to make contact with the back surface of facing member 241.

A description has been given above of a configuration of refrigeration apparatus 10 in range R1, which is around the upper edge of the perimeter of opening O of case section 20, and in range R2, which is around partition 24, when outer door 31 and inner doors 32 are closed. Note that a description of a configuration of refrigeration apparatus 10 in range R3 illustrated in FIG. 3, which is around the lower edge of the perimeter of opening O of case section 20, will be omitted because the configuration is similar to that in range R1 described with reference to FIG. 4, with the upper and lower sides reversed.

Next, pipe 60 will be described in detail. Pipe 60 is formed of, for example, metal with relatively high thermal conductivity, such as copper or aluminum. Pipe 60 is connected to freezing circuitry of refrigeration apparatus 10, and circulates refrigerant warmed by a compression effect of a compressor included in the freezing circuitry.

Figure 6:
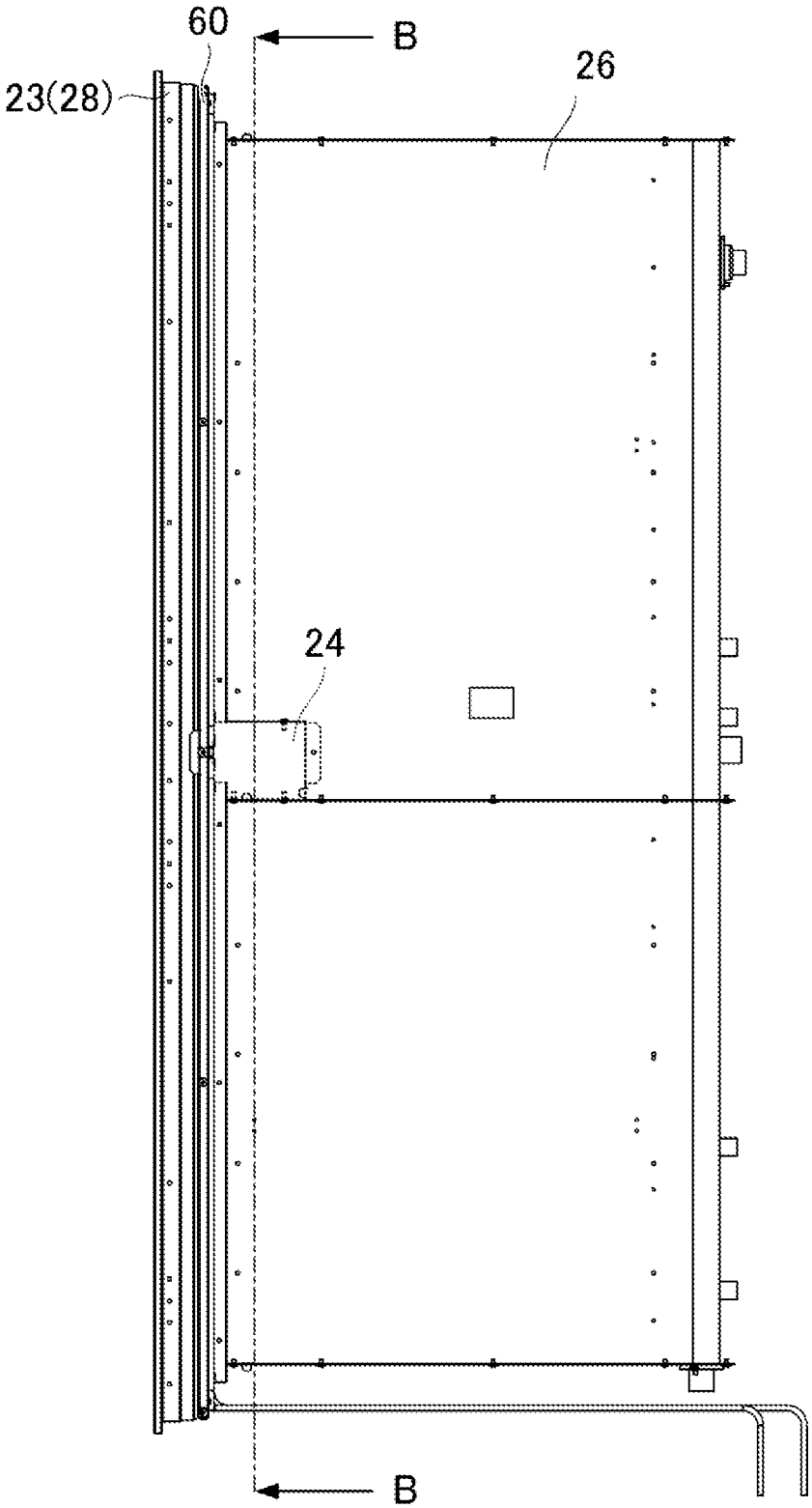
FIG. 6 is a side view for describing a position relation between an inner case, a packing, and a pipe of the refrigeration apparatus.
Figure 7:
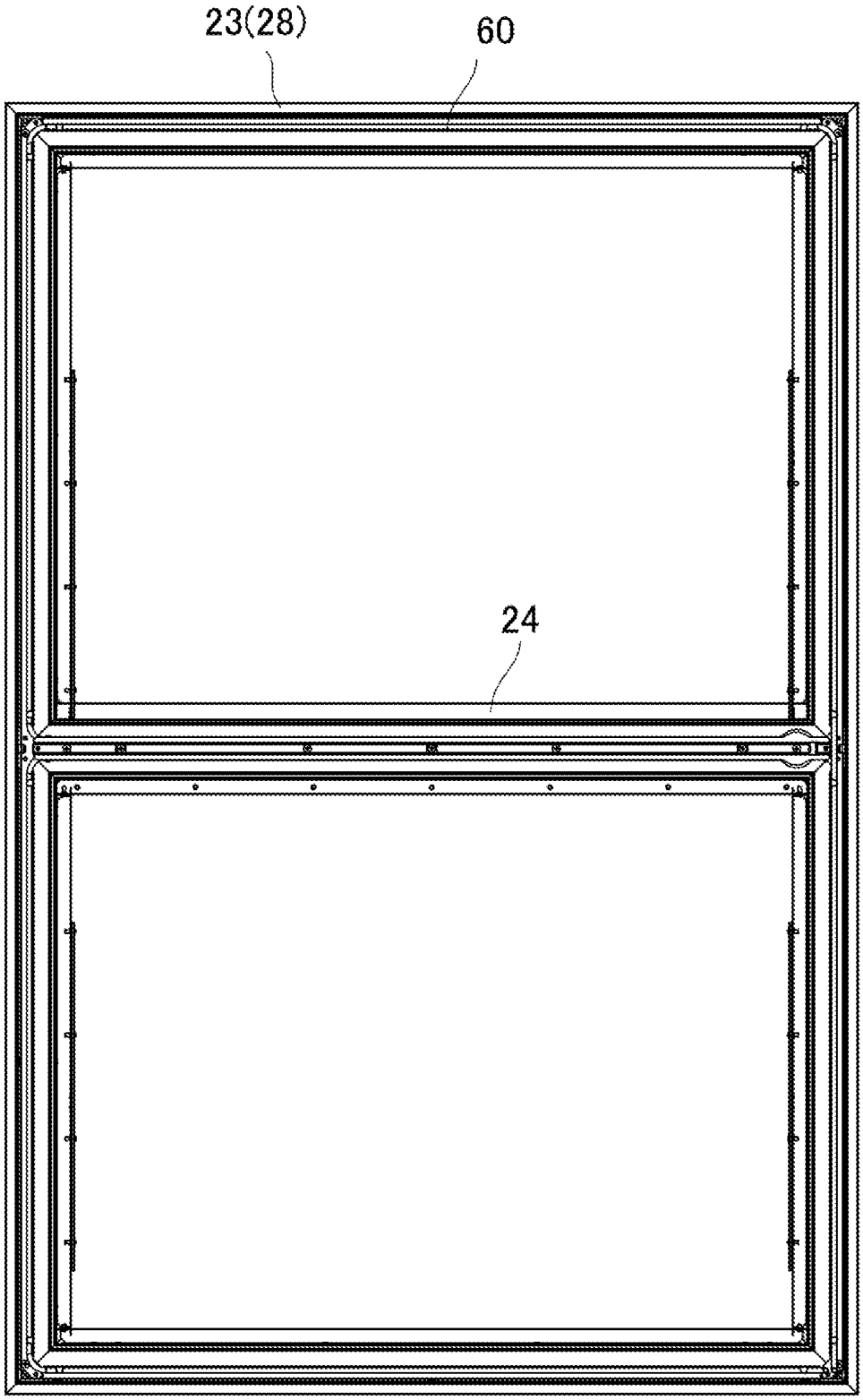
FIG. 7 is a cross-sectional view taken along the line B-B in FIG. 6.
Figure 8:
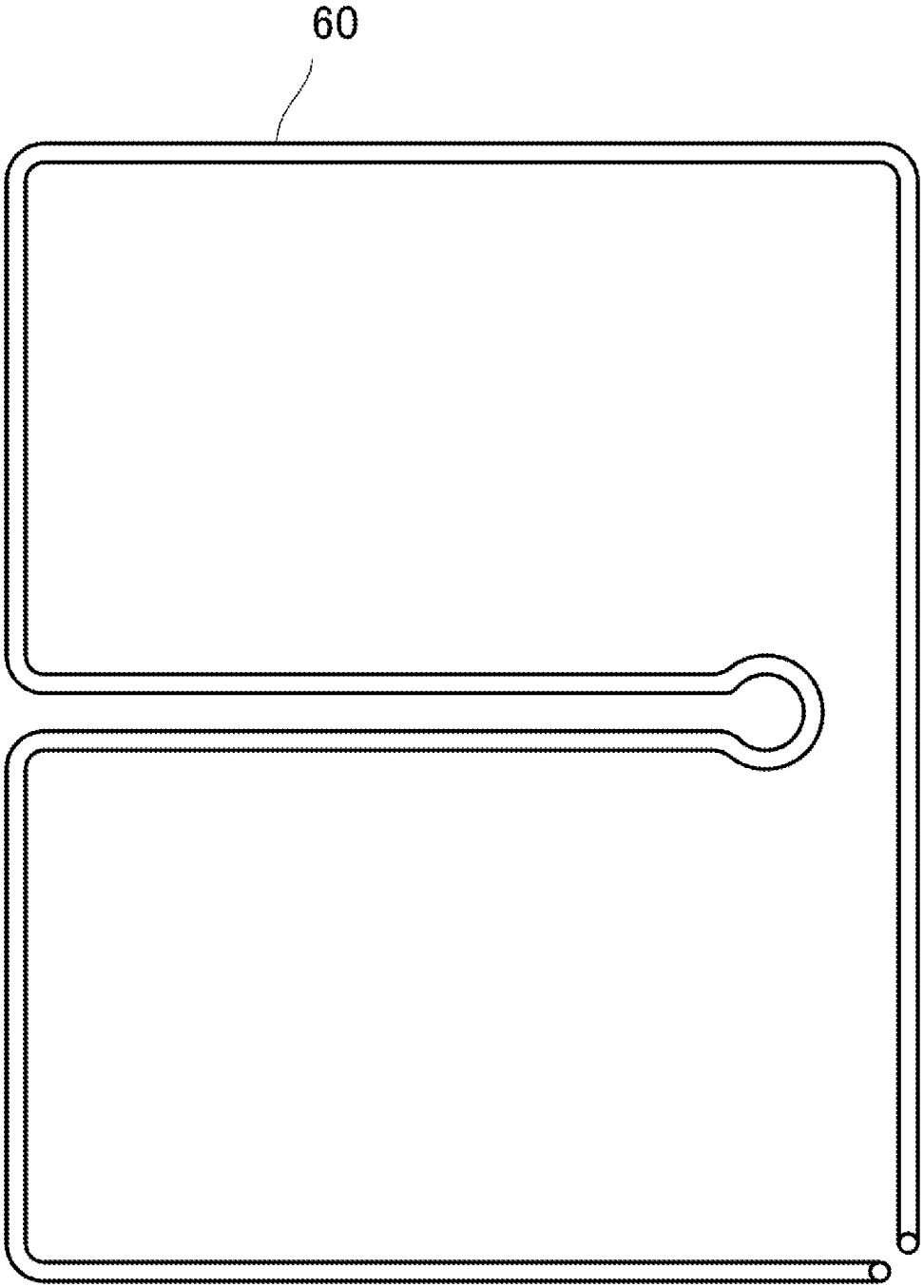
FIG. 8 is a schematic diagram illustrating an arrangement form of a pipe when only the pipe is viewed from the back side of the refrigeration apparatus.

FIG. 6 is a side view for describing a position relation between inner case 26, first peripheral edge section 23 (peripheral edge member 28), and pipe 60 of refrigeration apparatus 10. FIG. 6 illustrates refrigeration apparatus 10 viewed from the left side with outer case 27, door 30, and device storage 11 taken out from refrigeration apparatus 10. FIG. 7 is a cross-sectional view taken along the line B-B in FIG. 6. That is, FIG. 7 illustrates first peripheral edge section 23 and partition 24 viewed from the back side of refrigeration apparatus 10. FIG. 8 is a schematic diagram illustrating an arrangement form of pipe 60 when only pipe 60 is viewed from the back side of refrigeration apparatus 10, which is the same perspective as in FIG. 7. FIG. 8 emphasizes the diameter of pipe 60.

As illustrated in FIGS. 7 and 8, pipe 60 is placed in a continuous shape on the back side of peripheral edge member 28 (see FIG. 4) and between partition 24 and facing member 241 (see FIG. 5), covering almost entire perimeter of opening O and partition 24.

In particular, pipe 60 is placed in a double layer, upper and lower, at a section of partition 24. The area around partition 24 of opening O is easily cooled compared to the area around the perimeter of opening O due to cold air from two upper and lower openings divided by partition 24. In refrigeration apparatus 10 of the present embodiment, pipe 60 is placed in a double layer, upper and lower, at the section of partition 24 as described above, so that the section is provided with more heat by pipe 60 than the area around the perimeter of opening O. This effectively prevents condensation and frosting around partition 24.

When the freezing circuitry operates in refrigeration apparatus 10 with such a configuration, inside of refrigeration chamber R is refrigerated.

The temperature inside refrigeration chamber R at this time is lower than that of surrounding atmosphere. Thus, the temperature of the area around opening O illustrated in, for example, FIGS. 3, 4, and 5, particularly any one or more of first peripheral edge section 23, part of outer case section 22, partition 24, packing 40, and second peripheral edge section 321 of lower inner door 32, is possibly lower than that of surrounding atmosphere. The area where the temperature is lower than that of surrounding atmosphere possibly has condensation and frosting.

Refrigeration apparatus 10 according to the present embodiment, however, includes pipe 60 placed so as to surround first peripheral edge section 23 and partition 24 as illustrated in FIGS. 7 and 8, and warmed refrigerant circulates through pipe 60 when the freezing circuitry operates. Accordingly, the area around first peripheral edge section 23 (peripheral edge member 28) and facing member 241 of partition 24 is warmed by the warmed refrigerant circulating through pipe 60. This prevents condensation and frosting even when the area between first peripheral edge section 23 and inner doors 32 makes contact with outside air. In addition, pipe 60 is placed so as not to interfere with outer door 31, it is thus possible to prevent condensation and frosting in the area between first peripheral edge section 23 and inner doors 32 regardless of outer door 31 opened or closed.

Note that pipe 60 does not directly contact with metal reinforcing member 29 provided on the side of outer case 27, but is connected to reinforcing member 29 via peripheral edge member 28 formed of a synthetic resin plate. This prevents heat leakage to outside of outer case 27 due to the direct heat transfer from pipe 60 to reinforcing member 29 having high thermal conductivity. That is, the heat is effectively transferred to the area between first peripheral edge section 23 and inner doors 32, thereby effectively preventing condensation and frosting in that area.

As illustrated in FIG. 4, for example, pipe 60 is placed at approximately the same position as the upper edge of packing 40 in the vertical direction. At a section lower than opening O, pipe 60 is placed at approximately the same position as the lower edge of packing 40 in the vertical direction. At a section to the right of opening O, pipe 60 is placed at approximately the same position as the right edge of packing 40 in the right-left direction. Further, at a section to the left of opening O, pipe 60 is placed at approximately the same position as the left edge of packing 40 in the right-left direction. That is, around first peripheral edge section 23, pipe 60 is placed so as to almost overlap the peripheral edge of packing 40 in the front view of refrigeration apparatus 10.

Likewise, as illustrated in FIG. 5, for example, around partition 24, pipe 60 is placed so as to almost overlap the peripheral edge of packing 40 in the front view of refrigeration apparatus 10.

Such a configuration allows pipe 60 to effectively transfer the heat to the section around the perimeter of first peripheral edge section 23, which easily gets condensation and frosting.

Although an embodiment of the present disclosure has been described above, the present disclosure is not limited to the above embodiment, and can be implemented with variations as appropriate without departing from the spirit or scope of the present disclosure.

The above embodiment has described the case of two inner doors 32, but the present disclosure is not limited to this, and there may be more than two inner doors. In this case, the present embodiment can be applied by increasing the number of partitions.

The disclosure of Japanese Patent Application No. 2019-228074, filed on Dec. 18, 2019, including the specification, drawings and abstract, is incorporated herein by reference in its entirety.

INDUSTRIAL APPLICABILITY

The present disclosure facilitates providing a refrigeration apparatus capable of preventing condensation and frosting around an opening peripheral edge surrounding an opening, and a partition. The present disclosure thus has great industrial applicability.

REFERENCE SIGNS LIST

10 Refrigeration apparatus
11 Device storage
12 Body
20 Case section
21 Inner case section
22 Outer case section
23 First peripheral edge section

24 Partition
241 Facing member
242, 243 Facing surface
244 Protrusion
25 Partition plate
26 Inner case
27 Outer case
28 Peripheral edge member
29 Reinforcing member
291 First flange
292 Second flange
30 Door
31 Outer door
32 Inner door
321 Second peripheral edge section
33 Hinge
34 Hinge
35 Operation section
36 Knob
40 Packing
41 Packing
50 Thermal insulation material
60 Pipe

The invention claimed is:

1. A refrigeration apparatus comprising:

a case section that includes an opening;

an inner door that is provided with a heat insulation material inside, and that opens and closes the opening;

an outer door that is provided so as to cover the inner door while the inner door is closed, and that opens and closes the opening;

a peripheral edge member that is provided so as to surround the opening, and that includes a first section facing a peripheral edge section of the inner door in a closed state and a second section facing a peripheral edge section of the outer door in a closed state, the peripheral edge member being made of a resin;

a first packing that seals between the peripheral edge section of the inner door and the first section of the peripheral edge member in the closed state;

a second packing that seals between the peripheral edge section of the outer door and the second section of the peripheral edge member in the closed state; and a pipe that is placed along a third section of the peripheral edge member, wherein:

the third section faces the inner door, the pipe circulates refrigerant warmed by an effect of a compressor composing a refrigerating cycle, and the pipe is placed on an inner surface of the first section of the peripheral edge member so as to overlap a perimeter edge of the first packing in a front view.

2. The refrigeration apparatus according to claim 1, further comprising a plate member made of metal, wherein:

the case section includes an inner case section, and an outer case section that covers the inner case section, and the plate member connects the outer case section and the second section of the peripheral edge member.

3. The refrigeration apparatus according to claim 2, wherein:

the peripheral edge member includes a fourth section that connects the first section and the second section, and the fourth section extends in a direction away from the pipe.

4. The refrigeration apparatus according to claim 3, wherein the plate member includes:

a first flange with a substantially L-shaped cross section, the first flange being composed of a first portion along the second section of the peripheral edge member, and a second portion along the fourth section of the peripheral edge member; and a second flange that makes contact with the outer case section.

5. The refrigeration apparatus according to claim 1, further comprising a partition member, wherein:

a plurality of the inner doors are provided, the partition member is provided so as to partition the opening, and includes a facing section that faces the peripheral edge section of the inner door in the closed state, the first packing seals between the peripheral edge section of the inner door in the closed state and the facing section, and the pipe is placed along the facing section.

6. The refrigeration apparatus according to claim 1, wherein the first packing is attached to the peripheral edge member.

* * * * *